United States Patent [19]

Peterson et al.

[11] Patent Number: 4,998,427

[45] Date of Patent: Mar. 12, 1991

[54] METHOD FOR ROLLING ON-GAUGE HEAD AND TAIL ENDS OF A WORKPIECE

[75] Inventors: Robert S. Peterson, Indiana Township, Allegheny Country, Pa.; John A. Larsen, Phoenix, Ariz.

[73] Assignee: AEG Westinghouse Industrial Automation Corporation, Somerville, N.J.

[21] Appl. No.: 443,697

[22] Filed: Nov. 29, 1989

[51] Int. Cl.[5] ..... B21B 37/06

[52] U.S. Cl. ..... 72/9; 72/14; 72/16; 72/205

[58] Field of Search ..... 72/8, 9, 10, 12, 14, 72/15, 16, 17, 205

[56] References Cited

U.S. PATENT DOCUMENTS

| | | | |
|---|---|---|---|
| 3,507,134 | 4/1970 | Silva | 72/8 |
| 3,740,983 | 6/1973 | Peterson et al. | 72/16 |
| 3,765,203 | 10/1973 | Peterson | 72/9 |
| 3,768,286 | 10/1973 | Peterson . | |
| 3,782,151 | 1/1974 | Peterson et al. | 72/9 |
| 3,848,443 | 11/1974 | Peterson et al. . | |
| 4,011,743 | 3/1977 | Peterson et al. . | |
| 4,016,735 | 4/1977 | Peterson . | |
| 4,286,447 | 9/1981 | Peterson . | |

OTHER PUBLICATIONS

Hitachi Review, vol. 28, No. 5, 1979, pp. 245-249, Kitao et al., "Advance Gage Control System in Cold Tandem Mills".

*Primary Examiner*—Lowell A. Larson
*Assistant Examiner*—T. C. Schoeffler
*Attorney, Agent, or Firm*—Richard V. Westerhoff; Suzanne Kikel

[57] ABSTRACT

A method for making delivery gauge corrections at low mill speeds during threading and tailing out of a workpiece by varying the interstand tension of the workpiece. The tension between the last two stands is used with a desired tension and the delivery AGC by tension mode of an existing delivery automatic gauge control (AGC) to change the speed of the downstream stands. During the threading and tailing out phases, the delivery AGC by speed is turned off and set to zero. In the full run phase, the interstand regulators are changed to a tension by roll gap mode, and an existing delivery automatic gauge control (AGC) by speed is used to provide a stand speed reference for the downstream stands. In the full run phase, the delivery (AGC) by tension is turned off an set to zero. In the tailing out phase optionally, the tension between each stand is used in a similar manner to provide a speed reference change for each stand immediately downstream from where a tension controller is located.

14 Claims, 2 Drawing Sheets

METHOD FOR ROLLING ON-GAUGE HEAD AND TAIL ENDS OF A WORKPIECE

BACKGROUND OF THE INVENTION

1. FIELD OF THE INVENTION

The invention relates to a method in a tandem cold mill for rolling on gauge material in a workpiece, such as strip or sheet during threading and tailing out by varying the interstand tension in the workpiece. More specifically, the invention relates to employing an existing delivery automatic gauge control (AGC) in a tension mode, to change the speed of the downstream stands relative to the last to vary the interstand tension to obtain an on gauge length for the workpiece travelling through the mill when the mill is being operated at low speed.

2. DESCRIPTION OF THE PRIOR ART

Presently, in the threading and tailing out processes of a multi-stand tandem cold rolling mill for reducing a workpiece, such as strip, most of the out of tolerance or off gauge strip occurs during these low mill speeds, with very little or no off gauge strip occurring in the body of the strip at the full run of the mill when the mill is operating at a high speed.

During the low mill speeds, the roll gap of each stand is set at a desired setting and the reduction in the strip is being determined through the "tension by speed" mode of the mill where the interstand tension regulators control the speeds of the stands. The tension by speed controllers make stand speed corrections which are added to the mill operator's stand speed settings. When the stand speed settings are changed, there will be off-gauge strip leaving the mill since the mill speed setup has been modified by the strip tension by speed regulators. During low mill speeds when all the mill interstand tension regulators modify stand speed to regulate the strip tension to a strip tension setting determined by the mill operator, the only way possible to control strip delivery gauge by a delivery automatic gauge control system which monitors the strip thickness leaving the mill, is for this delivery AGC system to change the strip interstand tension in a manner to bring the delivery strip gauge (thickness) within tolerance. There is a limit to which the delivery AGC system by tension is permitted to change the interstand strip tension relative to the operator strip tension setting of the mill operator which is typically ±40% of the operator's setting. Usually, the interstand AGC by tension system is saturated during the low speed of the mill in making all the strip tension connections permitted. Even with this situation, the strip delivery gauge can still not be within tolerance.

When the last stand of a mill has sandblasted rough rolls, which is the case for a sheet mill, the interstand strip tension between the last two stands is usually regulated by changing the speed of one or both of these stands regardless of the mill speed. When this is the case, the interstand strip tension between the last two stands is changed by a delivery AGC system to bring the delivery strip on gauge. Again the amount of tension change permitted in the strip is typically ±40% of the operator's strip tension setting. If the delivery AGC by tension system is energized at all times during the rolling process, that is, at both low and high mill speeds, the delivery AGC by tension system usually goes into a saturation state. When the delivery AGC by tension controller is in this saturation state making the maximum strip tension corrections permitted, it is impossible for the delivery AGC to make any further delivery gauge corrections. This quite often happens, i.e. the controller becomes saturated at high mill speeds, and remains saturated when the mill speed is changed to a lower speed. At high mill speeds, there is another delivery AGC system which is available which can control the delivery gauge in the strip. This is known as a delivery AGC by speed system.

The delivery AGC system by tension is not required when this delivery AGC by speed system is in operation. Present mill practice is to keep both the delivery AGC by speed and the delivery AGC by tension systems in operation at high mill speeds. Presently in existing mills the delivery AGC by tension system is not energized selectively where it is only turned on at low mill speeds and also not all the interstand strip tensions are changed to make delivery gauge corrections at low mill speeds, such as threading and tailing out. Unfortunately, this practice and operation of the mill does not prove to be adequate to produce on gauge strip relative to the body of the strip being reduced in the full run of the mill.

Some examples illustrating the relationship between automatic gauge control and speed and tension regulators for gauge control are shown in U.S. Pat. Nos. 3,740,983; 3,765,203; 3,768,286; 3,848,443; 3,782,151; 4,011,743; 4,016,735; and 4,286,447.

In the full run of the mill, strip within gauge tolerance is obtained through the operation of the "tension by roll gap" mode where the interstand tension regulators control the roll gap of the stands, and through the selective operations of the entry and the delivery automatic gauge control (AGC) systems. The delivery AGC system generally uses an X-ray gauge at the delivery side of the last stand for monitoring deviations in the strip and may consist of what is referred to as an "AGC by speed" mode and an "AGC by tension mode." The "AGC by speed" mode generates the speed changes in the downstream stands, and the "AGC by tension" mode generates the tension changes between stands.

In the operation of the mill, when the mill is accelerated from the low mill threading speed to the normal high mill full run speed, the strip usually goes thin. When the mill is decelerating from the high run speed to the low tailing out speed, the strip has a tendency to go thick. This phenomena is known in the industry as speed effect. When the mill is accelerating, the automatic gauge control (AGC) systems may be fully functional and the interstand tension regulators are generally changed from the tension by speed mode to the tension by gap mode. The AGC systems make stand speed corrections to correct the delivery gauge of the strip which usually is thick. The AGC corrections are made in a direction to correct for thick strip which means that the AGC corrections make the strip go thinner. In the meantime, the speed effect occurs causing the strip to go even thinner. The net result is that the strip can become too thin. In the meantime, the strip is accelerating to the high run speed before the delivery AGC system can bring the strip back on gauge. Since the strip is going through the mill at a high rate of speed before the strip gets on gauge, a great amount of strip will not be within gauge tolerance.

When the mill is decelerating, that is, when the mill speed is going from high to low, the automatic gauge control systems generally are still operating and the interstand tension is changed from the "tension by gap"

mode to the "tension by speed" mode for low mill speed. Due to the speed effects and to the instability and/or saturation of several of the systems for gauge control of the strip in the tailing out phase of the mill, the strip tends to become too thick.

Ideally, if the strip is brought on gauge as soon as possible on the head end during threading, and on the tail end during tailing out, there will be less off gauge strip.

SUMMARY OF THE INVENTION

The present invention has solved the above described problems by providing a method for rolling a greater length of on gauge material in the threading and tailing out of a workpiece in a tandem cold mill. The invention selectively energizes the delivery AGC by tension so that the delivery AGC by tension is only operational when the delivery AGC by speed system is not operational. Of course, the delivery AGC by tension system will now only be operational at low mill speeds. When this is the case, the delivery AGC by tension can make a full strip tension correction (typically ±40% operator setting) when the mill speed goes from high speed to low speed during tailout of the strip from the mill. This is not the case when the delivery AGC by tension is energized at all mill speeds since the delivery AGC by tension controller is saturated previously to the time that the mill speed changes from high speed to low speed.

Also in addition to the delivery AGC by tension system regulating strip interstand tension between the last two stands only at low mill speed, the interstand strip tension between all stands is changed by a delivery AGC by tension system to bring the delivery strip gauge within tolerance.

The present invention provides a novel use of the delivery automatic gauge control system where the "AGC by tension" mode is the only automatic gauge control system being used during threading and tailing out to alter the speeds of the downstream stands. The delivery X-ray gauge at the exit side of the last stand is used to activate the "delivery AGC by tension" mode, and the interstand tension between the last two stands is measured. The output from the "delivery AGC by tension" mode, a preset tension value, and the measured tension between the last two stands are fed into the tension controller between the last two stands to send a speed reference change to each of the stands downstream from the last stand.

Optionally, in the tailing out phase, a variation of the above method of operation is employed. The output from the "delivery AGC by tension" mode is sent to the interstand tension controllers between all but the last two stands, and the output from each tension controller including that of the last two stands is sent to each of the stands downstream relative to the respective tension controller to generate a stand speed reference change with respect to the interstand tension in the downstream stands or stand.

In the invention, preferably the "delivery AGC by speed" mode will be the only automatic gauge control system used for the full run or high speed of the mill.

In the invention, the delivery AGC by tension system is energized or turned on only for low mill speeds such as threading and tailing out phases, and the interstand tension in the strip is changed to make delivery gauge corrections at low mill speeds.

It is, therefore, a broad object of the invention to provide in a multi-stand tandem cold mill, a method for operating the mill to produce a greater amount of length of on gauge material in a workpiece, thereby increasing the percentage of usable material for further processing More particularly, it is an object of the invention to provide a method for producing on gauge material in the head end of the workpiece during the threading phase and in the tail end of the workpiece in the tailing out phase of the operation of the mill.

It is a further object to provide a method of using an automatic gauge control by tension system to change the speed of the downstream stands whereby the interstand tension is only varied to make delivery gauge corrections at low mill speed during the threading and tailing out phases of the workpiece.

It is a further object of the invention to accomplish these objectives by using an existing delivery automatic gauge control system having at least an "AGC by tension" mode and an "AGC by speed" mode.

A further object of the invention is to employ the delivery automatic gauge control by tension mode as soon as possible in the threading and tailing out phases, and to use the delivery automatic gauge control by speed mode in the full run phase of the mill.

It is a still further object of the invention to energize the delivery automatic gauge control by tension mode only in the low speed or threading and tailing out phases with the delivery automatic gauge control by speed mode being de-energized, and to energize the delivery automatic gauge control by speed mode only in the high speed or full run phase of the mill with the automatic gauge control by tension being de-energized.

A further object of the invention is to use the delivery automatic gauge control by tension and combining this control with the interstand tension by speed control to regulate the speed of the downstream stands to make gauge corrections in the threading and tailing out phases.

Still, a broad object of the invention is to selectively energize the delivery automatic gauge control by tension system so that the delivery automatic gauge control by tension is operational when the delivery automatic gauge control by speed system is not operational.

A further object of the invention is to only employ the automatic gauge control by tension system at low mill speeds whereby full strip tension corrections can be made.

These and other objects of the invention will be more fully understood from the following description of the invention, on reference to the illustrations appended hereto.

DETAILED DESCRIPTION OF THE PREFERRED EMBODIMENTS

Figure 1:
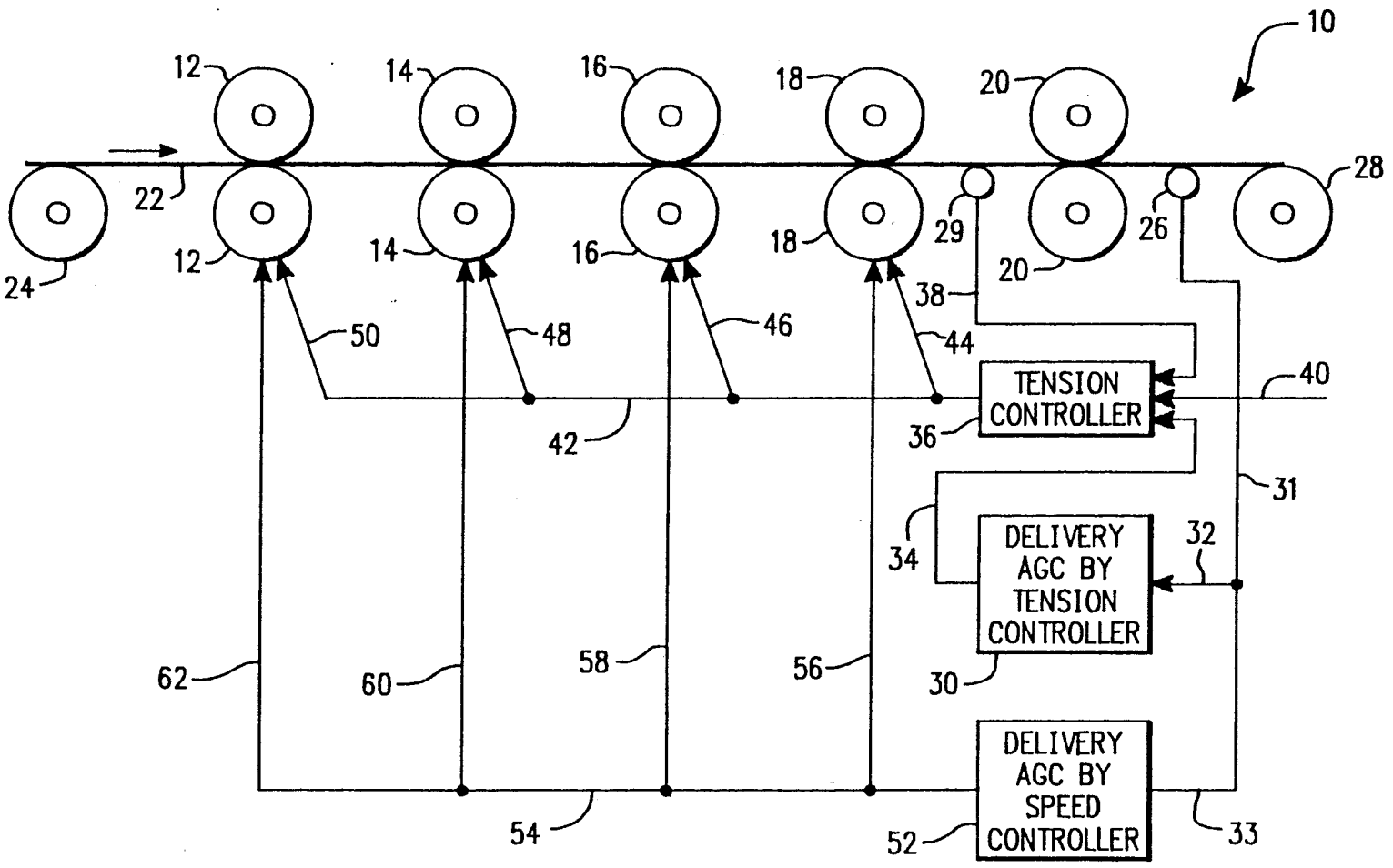
FIG. 1 is a schematic diagram of a tandem cold mill of a first embodiment of the invention, employed in the threading, the full run, and the tailing out phases.

FIG. 1 illustrates a simple schematic of a five stand tandem cold mill (10) for rolling a ferrous or nonferrous workpiece such as strip or sheet. The first stand is represented by work rolls 12. The second stand is represented by work rolls 14. The third stand 3 is represented by work rolls 16. The fourth stand 4 is represented by work rolls 18. The fifth or last stand is represented by work rolls 20. Each of work rolls 12–20 are driven by motors regulated by speed regulators which are not shown but wellknown in the art. The workpiece 22 is brought into the mill 10 by pay off reel 24, and travels from left to right sequentially through the five stands. Work rolls 12, 14, 16, 18, and 20 form a roll gap for the rolls which roll gap is controlled through a hydraulic roll gap control system (not shown). After the strip exits the final stand represented by work rolls 20, the strip travels over a delivery X-ray gauge 26 onto a tension reel 28. Between the last two stands of work rolls 18, 20 respectively, is a tensiometer 29 which measures the interstand tension between these last two stands, more about which will be discussed hereinafter.

Even though not shown in FIG. 1, a tensiometer is located between each of the downstream stands to measure the interstand tension between work rolls 12, 14, representing the first and second stands respectively; between work rolls 14, and 16 representing the second and third stands respectively; and between work rolls 16, 18 representing the third and fourth stands, respectively. These tensiometers between all five stands operate according to well-known rolling mill practice to detect and measure the tension, and are part of the mill equipment consisting of speed regulators and tension regulators used in the tension by speed mode and in the tension by roll gap mode for operation of the various phases of the mill for the reduction of the workpiece.

The mill of FIG. 1 represents a typical existing tandem cold mill having back up rolls, a hydraulic roll gauge control system, roll bending means, interstand tension controllers, tension by speed regulators, tension by roll gap regulators. An entry automatic gauge control (AGC) system, a delivery automatic gauge control (AGC) system, etc. These devices operate in accordance with well-known rolling mill practice for reducing the thickness of work piece 22.

As stated herein above, the present invention uses this existing tandem cold rolling mill, and its devices and various control systems to produce an on gauge head end and an on gauge tail end in workpiece 22 in the following manner:

Still referring to FIG. 1 and in threading of workpiece 22 through the mill 10, the speed of mill 10 is maintained at a relatively low speed. The head end of workpiece 22 reaches the last stand represented by work rolls 20, where the tension in workpiece 22 is detected by the tensiometer 29 prior to entry of workpiece 22 into the roll gap of rolls 20. Upon exit of the head end of workpiece 22 from work rolls 20, the actual delivery gauge or thickness workpiece 22 is measured by delivery X-ray gauge 26. The tension regulators including that of tensiometer 29 are in their "tension by speed" mode. As seen to the far right of FIG. 1, a signal from X-ray gauge 26 proportional to the actual thickness in the head end of workpiece 22 is produced along lead 31. This signal along lead 31 is compared at a summing junction (not shown) with a gauge reference signal determined by the operator of the mill. This gauge reference signal is proportional to the desired output gauge. If the desired gauge signal is not equal to the actual gauge signal, an error signal is developed. This error signal is used to activate the circuit of delivery automatic gauge control (AGC) by tension controller 30 as shown on lead 32 branching off from lead 31. As shown on lead 34, the signal from the delivery AGC by tension controller 30 is sent to tension controller 36 and summed in tension controller 36. Controller 36 also receives the signal from tensiometer 29 as shown on lead 38 which signal represents the actual tension in the head end of workpiece 22 and a preset signal as shown on lead 40, which is the desired tension supplied by the mill operator or the computer. The output signal from tension controller 36 is an error tension value for workpiece 22. This error tension signal is shown on lead 42, and represents the amount that the speed of downstream stands of work rolls 12, 14, 16, and 18 must change in order to contribute to obtaining the desired tension in workpiece 22 between the downstream stands to produce the required thickness in workpiece 22 as it exits from the last stand of work rolls 20. The speed regulators for work rolls 12–20 are driven in accordance with a speed setting from the mill operator. The change in speed of each stand of work rolls 12–18 is added to the operator's setting for that stand. The change in speed of each stand influences the interstand tension generated in the workpiece between each stand, and causes a change in the mill stretch for the adjacent upstream stand which changes the roll gap of this stand until the strip is at a desired gauge.

This stand speed reference change for work rolls 18 is shown by lead 44; for work rolls 16, by lead 46; for work rolls 14 by lead 48; and for work rolls 12 by lead 50.

Tension controller 36 and delivery AGC by tension controller 30 can be operated through the acceleration phase into the full run operation of mill 10. When mill 10 is operating at full run, work rolls 12–20 are rotating at a constant high speed. The tension regulators, including tensiometer 29, and tension controller 36, are changed from the tension by speed mode to the tension by roll gap mode. The delivery AGC by tension controller 30 is turned off, and the delivery automatic gauge control (AGC) by speed controller indicated in block 52 is turned on. When the delivery AGC by tension 30 is turned off, the delivery AGC by tension reference correction signal is linearly slowly delayed to zero. During this time the decayed AGC by speed 52 is controlling the delivery gauge in work piece 22.

The thickness of workpiece 22 exiting from work rolls 20 is still being measured by x-ray gauge 26 and a signal proportional to the delivery gauge is sent to a summing device (not shown). The actual delivery gauge is compared to a desired delivery gauge and a delivery gauge error signal indicated on lead 33 is sent to the delivery AGC by speed controller 52. The output signal from the deliver AGC by speed controller 52 is shown on lead 54 and represents an amount that the speed of downstream stands of work rolls 12, 14, 16, and 18 must be changed in order to contribute to obtaining the desired tension in workpiece 22 between the downstream stands to produce the required thickness in workpiece 22 as it exits from the last stand of work rolls 20. At the same time the roll gap of each stand is being controlled by the tension by gap regulators and by the speed changes in the adjacent stands. The stand speed reference change obtained from the delivery AGC by speed controller 52 is shown on lead 56 for work rolls 18, on lead 58 for work rolls 16, on lead 60 for work rolls 14, and on lead 62 for work rolls 12.

For the tailing out phase of the mill 10, in order to obtain or maintain an on gauge workpiece in accordance with the invention, the delivery AGC by speed controller 52 is turned off, and the delivery AGC by tension controller 30 is turned on again. When the mill decelerates to the slow tail out speed, a mill detector is de-energized which in turn de-energizes the delivery AGC by speed controller 52 and energizes the delivery AGC by tension controller 30.

The AGC by tension controller 30 now has full tension range to make delivery gauge corrections In the previous well-known operation of the mill when the delivery AGC by tension controller 30 was in operation at all times, the controller 30 would be at a maximum tension with no room for making delivery gauge corrections. In practicing the method of the invention, the AGC tension controller 30 has the full tension range available to make workpiece gauge corrections.

In the tailing out phase, the tail end of workpiece is travelling through the mill at a low constant speed. The tension regulators are changed back to the tension by speed mode and the tensiometer 29, tension controller 36, x-ray gauge 26, and delivery AGC by tension controller 30 are operating in the same manner as explained for the threading phase of the operation of mill 10.

Figure 2:
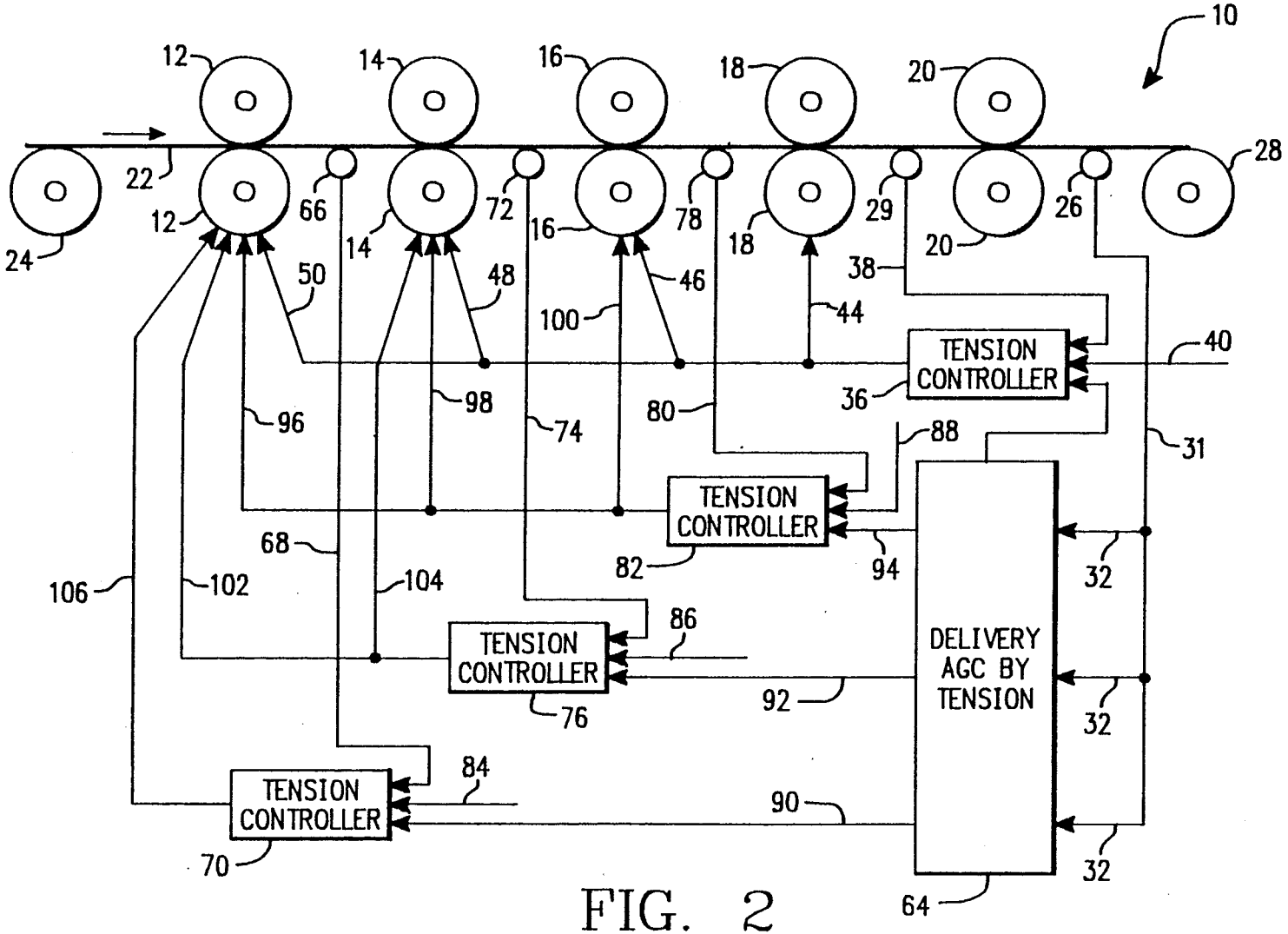
FIG. 2 is a schematic diagram of a tandem cold mill of a second embodiment of the invention employed generally in the tailing out phase of the operation of the mill.

FIG. 2 illustrates a second embodiment which can optionally be used preferably in the tailing out phase of the mill. In FIG. 2, the same numbers represent the same as components in FIG. 1. This FIG. 2 includes in the method of operation of the mill of energizing the delivery AGC by tension indicated in block 64 between the last two stands of work rolls 18 and 20 as explained in FIG. 1 and also between the downstream stands of work rolls 12, 14, and 16.

In the tailing out phase, x-ray gauge 26 is measuring the thickness in workpiece 22 and a delivery gauge error signal developed in the same manner as that of FIG. 1 is being sent as shown by lines 31 and 32 to the delivery AGC by tension controller 64, which is equivalent to that indicated at 30 in FIG. 1.

Tensiometer 66 located between work rolls 12 and 14 sends its signal representing the actual tension between rolls 12 and 14 on lead 68 to tension controller 70. Tensiometer 72 located between work rolls 14 and 16 sends the measured actual tension on lead 74 to tension controller 76. Tensiometer 78 located between work rolls 16 and 18 sends its signal on lead 80 to tension controller 82. A preset or desired tension value is also provided as input to tension controllers 70, 76, and 82 as indicated on leads 84, 86, and 88, respectively.

From tension controller 82, there is a speed reference change to the stands of work rolls 12, 14, and 16 as indicated on leads 96, 98, and 100. From tension controller 76, there is a speed reference change to the stands of work rolls 12 and 14 as indicated on leads 102 and 104, and from tension controller 70 there is a stand speed reference to work rolls 12 as indicated on lead 106.

Using this variance of the method of the invention for the tailing out phase of the mill means that the tension between each stand is being varied to make delivery gauge corrections in the tail end of the workpiece, resulting in a greater length of the tail end being within gauge tolerance. This technique for FIG. 2 may drastically change the mill setup, but may be irrelevant in that the workpiece is leaving the mill, and the mill can be reset for the next coil of material.

The method of operation of a tandem cold mill according to the teachings of the invention can be used in all stands of a mill for rolling strip, sheet, etc. and particularly in a tin tandem cold mill or in a sheet tandem cold mill.

In a sheet mill, the last stand has rough rolls to provide a surface finish to the workpiece. Very little reduction is done in this last stand. Present mill operating practice of a sheet mill is to employ a delivery AGC system which makes delivery gauge corrections by controlling the strip tension between the last two stands at all times, that is, strip gauge corrections are made in the last stand during the low and high speeds of the mill. At the same time another delivery gauge AGC regulator is used to control the speed relationship of the stands to make gauge corrections in the next to last stand where the strip back tension of this next to last stand is controlled by controlling the roll gap of the next to last stand which is only done at high mill speeds. These delivery gauge AGC systems are operational at all times. Because of mill operating problems, it is not desirable to permit the strip tension to vary at high mill speeds. If the strip tension gets too high, the strip may break or edge cracks in the strip may result. If the strip tension is too low there may result a pinch in the strip in the stand roll bit which causes the strip to break, or low strip tension can cause wavy edges.

A better way of controlling delivery gauge in a sheet mill is to change the strip tension only at low speeds by using a delivery AGC by tension and to employ a delivery AGC by speed at the higher mill speeds where the delivery AGC by tension system is turned off. This method is in accordance with the teachings of the invention.

In the invention, the mass flow law applies. This mass flow is stated as $V, H, = V_2 H_2 = V_3 H_3 = V_4 H_4 = V_5 H_5$, where the symbol V represents the velocity of the workpiece between the stands and leaving the last stand, and the symbol H represents the thickness in the workpiece between the stands and leaving the last stand. This mass law must apply, otherwise the workpiece will either accumulate between the stands or break.

An existing tandem cold mill has at least two types of delivery automatic gauge control modes. From the above, these two modes are delivery AGC by tension and delivery AGC by speed. The invention teaches employing the AGC by tension mode in the threading and tailing out phases. This is the most likely mode to employ during these phases for the following reason.

Controlling of delivery gauge in the threading and tailing out phases can only be done by controlling the speeds of the stands, since, it is impractical to change the roll gap. At these low speeds, if the tension in the workpiece were to be controlled by changing the roll gap, the roll gap can only be changed slowly which will result in unsatisfactory workpiece tension regulation. If the roll gap is changed quickly, the workpiece may pinch in the roll bite causing breakage of the workpiece. During these phases the interstand tension regulators are, and must be, in their tension by speed mode.

If the AGC by speed controller 52 were to be used in the threading and tailing out phases, then the two speed regulators for the AGC by speed mode and the tension by speed mode would not function properly in that there would be interaction between the two speed regulators, with the tension by speed regulator overriding the delivery AGC by speed regulator. From the above, it can be appreciated that it is impossible to control both the interstand tension in the workpiece 22 and the delivery gauge by changing the speed of the stands at the same time, and thus, the reason for using the delivery AGC by tension mode for gauge corrections.

The invention teaches the measuring of the delivery workpiece thickness after the last stand of work rolls 20. It is well known in the industry that delivery gauge can be made in any of the stands. Preferably, the delivery gauge corrections are made in the last stand according to the invention in order to decrease the transport time delay of the delivery gauge control system. The transport time delay is defined as that time which the workpiece takes to travel from the stand to the x-ray gauge which ultimately makes the gauge corrections. The closer the mill stand is to the delivery x-ray gauge, the smaller the transport time delay, and the faster the delivery AGC is operating. It is reasonable, therefore, that in accordance with the teachings of the invention, the best manner to control the delivery x-ray gauge is to change the tension in the workpiece between the last two stands resulting in the delivery gauge corrections being made in the last stand.

Whereas particular embodiments of the invention have been described above for purposes of illustration, it will be evident to those skilled in the art that numerous variations of the details may be made without departing from the invention as defined by the appended claims.

We claim:

1. A method for rolling on gauge material in the head end and the tail end of a ferrous or non-ferrous workpiece such as travelling through several stands of a tandem cold mill, each stand having two work rolls defining a roll gap, the steps comprising:

in the threading phase of said mill, employing a tension by speed mode for the interstand tension regulators, and using a tension controller between the last two stands of the mill to receive input from a tension measuring device representative of the actual tension in said workpiece between said two last stands, providing a desired tension input to said tension controller, measuring the delivery gauge thickness of said workpiece at the exit end of the last stand of said mill by a delivery gauge sensor and producing a delivery gauge error signal, energizing and operating only a delivery automatic gauge control by tension controller which is activated by said delivery gauge error signal and generating and sending an output from said automatic gauge control by tension controller to said tension controller between said last two stands, in said tension controller between said last two stands comprising said actual tension in said workpiece between said last two stands to said desired tension input and summing the tension difference with said output from said delivery automatic gauge control by tension controller to produce a tension error output, sending this tension error signal to the downstream stands relative to the last stand to change the speed of each of the downstream stands relative to said last stand at the same rate by using said tension error output as a stand speed reference to vary the interstand tension in the workpiece to effect a gauge correction to obtain said on gauge material in said head end of said workpiece, and for the full run operation of said mill, deactivating said delivery automatic gauge control by tension controller, thereby discontinuing said changing of the speed of each downstream stand by said stand speed reference based on said employment of said delivery automatic gauge control by tension controller and said tension controller between said last two stands, changing said interstand tension regulators from said tension by speed mode to a tension by roll gap mode, activating and operating only a delivery automatic gauge control by speed controller to generate a new stand speed reference for changing the speed of each of said downstream stands relative to said last stand, and supplying said change in speed reference to the speed regulator of each downstream stand relative to said last stand to drive the rolls of each downstream stand at a speed such that the speed of each stand cooperates with the tension by roll gap control for gauge control of said workpiece.

2. A method of claim 1, the steps further comprising:

in the tailing out phase of said mill, deactivating said delivery automatic gauge control by speed controller, employing said tension by speed mode for the interstand tension regulators, and using the tension controller between the last two stands of the mill to measure the actual tension in said workpiece between said two last stands, providing a desired tension input to said tension controller, measuring the delivery gauge thickness of said workpiece at the exit end of said last stand of said mill by said delivery gauge sensor and producing a delivery gauge error signal, energizing and operating only said delivery automatic gauge control by tension controller which is activated by said delivery gauge error signal and generating and sending an output from said automatic gauge controller by tension controller to said tension controller located between said two last stands, in said tension controller between said last two stands comparing said actual tension in said workpiece between said last two stands to said desired tension input and summing the tension difference with said output from said delivery automatic gauge control by tension controller to produce a tension error output, and changing the speed of each of the downstream stands relative to said last stand at the same rate by using said tension error output as a stand speed reference to vary the interstand tension in the workpiece to effect a gauge correction to obtain said on gauge material in said tail end of said workpiece.

3. A method of claim 2, wherein said workpiece being rolled is sheet metal.

4. A method of claim 2, wherein said workpiece being rolled in strip metal.

5. A method for rolling on gauge material in the head end and tail end of a ferrous or non-ferrous workpiece such as strip or sheet travelling through several stands of a tandem cold mill, the steps comprising:

in at least the threading and tailing out process of said mill, sensing the actual tension in the workpiece between the last two stands of said mill, sensing and measuring the delivery gauge thickness of said workpiece at the exit end of the last stand of the mill, and producing a delivery gauge error signal, energizing and operating only a delivery automatic gauge control by tension controller while non-energizing a delivery automatic gauge control by speed controller, employing said delivery gauge error signal to initiate operation of said delivery automatic gauge control by tension controller, combining the output from said delivery automatic gauge control by tension controller with a desired preset tension value and said actual tension value to produce a tension error output, employing said tension error output as being representative of a change in speed reference, and supplying said change in speed reference to the speed regulator of each of the downstream stands relative to the last stand to drive the rolls of each downstream stand at a speed such as to vary the interstand tension in the workpiece to effect a gauge correction to obtain said on gauge material in the head end and in the tail end of the workpiece in said threading and tailing out processes.

6. A method for rolling an on gauge thickness in at least the head end of a ferrous or non-ferrous workpiece such as strip or sheet travelling through several stands of a tandem cold mill, said stands each having driven work rolls which define a roll gap, the steps comprising:

in at least the threading process of said mill, sensing the actual tension in the workpiece between the last two stands of said mill, sensing and measuring the delivery gauge thickness of said workpiece at the exit end of the last stand of said mill, and producing a delivery gauge error signal, energizing and operating only a delivery automatic gauge control by tension controller, while non-energizing a delivery automatic gauge control by speed controller, employing the delivery gauge error signal to initiate operation of said delivery automatic gauge control by tension controller to produce an output value, combining the output from said delivery automatic gauge control by tension controller with a desired preset tension value and said actual tension value to produce a tension error output, employing said tension error output as being representative of a change in speed reference, and supplying said change in speed reference to the speed regulator of each downstream stand relative to the last stand to drive the rolls of each downstream stand at a speed such as to vary the interstand tension in the workpiece to effect a gauge correction to obtain said on gauge thickness in the head end of said workpiece in said threading process.

7. A method of claim 6, the steps further comprising:

in the tailing out process of said mill, energizing and operating only said delivery automatic gauge control by tension controller, and deenergizing said delivery automatic gauge control by speed controller used in the full run process of said mill, sensing the actual tension in the workpiece between said each stands of said mill, sensing the delivery gauge thickness of said workpiece at the exit end of the last stand of said mill, and producing a delivery gauge error signal, employing the delivery gauge error signal to initiate operation of said delivery gauge automatic gauge control by tension controller to produce an output value, combining the output from said delivery automatic gauge control by tension controller with a preset desired tension value for the workpiece between two neighboring stands and the actual tension in said workpiece between said two neighboring stands to produce a tension error output, employing said tension error output for said two neighboring stands as being representative of a change in speed reference, and supplying said change in speed reference to the speed regulator of each downstream stand relative to the location from which the actual tension in the workpiece is being sensed in order to drive the work rolls of said each downstream stand at a speed as to vary the interstand tension in the workpiece to effect a gauge correction to obtain said on gauge thickness in the tail end of said workpiece in said tailing out process.

8. A method of claim 6, the steps further comprising:

prior to the full run process of said mill, de-energizing said delivery automatic gauge control by tension controller with its output slowly decaying to zero, and in the full run process of said mill, energizing and operating only said delivery automatic gauge control by speed controller, sensing and measuring the delivery gauge thickness of said workpiece at the exit end of the last stand of the mill, and producing a delivery gauge error signal, employing said delivery gauge error signal to initiate operation of said delivery automatic gauge control by speed controller, producing an output from said delivery automatic gauge control by speed controller, and employing said automatic gauge control by speed output as being representative of a change in speed reference, and supplying said change in speed reference to the speed regulator of each downstream stand relative to said last stand to drive the rolls of each downstream stand at a speed such that the speed of each stand cooperates with the tension by roll gap control for gauge control of said workpiece.

9. A method for rolling an on gauge thickness in at least the head end of a ferrous or non-ferrous workpiece such as a strip or sheet travelling through several stands of a tandem cold mill, said stands each having driven work rolls which define a roll gap, the steps comprising:

in the tailing out process of said mill, energizing and operating only a delivery automatic gauge control by tension controller while a delivery automatic gauge control by speed controller system in said mill is deactivated, sensing the actual tension in the workpiece between said each stands of said mill, sensing the delivery gauge thickness of said workpiece at the exit end of the last stand of said mill, and producing a delivery gauge error signal, employing the delivery gauge to initiate operation of said delivery gauge automatic gauge control by tension controller to produce an output value, combining the output from said delivery automatic gauge control by tension controller with a preset desired tension value for the workpiece between two neighboring stands and the actual tension in said workpiece between said two neighboring stands to produce a tension error output, employing said tension error output for said two neighboring stands as being representative of a change in speed reference, and supplying said change in speed reference to the speed regulator of each downstream stand relative to the location from which the actual tension in the workpiece is being sensed in order to drive the work rolls of said each downstream stand at a speed to vary the interstand tension in the workpiece to effect a gauge correction to obtain said on gauge thickness in the tail end of said workpiece in said tailing out process.

10. A method for rolling on gauge material in the head end and the tail end of a ferrous or non-ferrous workpiece such as travelling through several stands of a tandem cold mill, each stand having two work rolls defining a roll gap, the steps comprising:

in the threading phase of said mill, employing a tension by speed mode for the interstand tension regulators, and using a tension controller between the last two stands of the mill to receive input from a tension measuring device representative of the actual tension in said workpiece between said two last stands, providing a desired tension input to said tension controller, measuring the delivery gauge thickness of said workpiece at the exit end of the last stand of said mill by a delivery gauge sensor and producing a delivery gauge error signal, energizing and operating only a delivery automatic gauge control by tension controller which is activated by said delivery gauge error signal and generating and sending an output from said automatic gauge control by tension controller to said tension controller between said last two stands, while allowing a delivery automatic gauge control by speed controller to remain deactivated, in said tension controller between said last two stands comparing said actual tension in said workpiece between said last two stands to said desired tension input and summing the tension difference with said output from said delivery automatic gauge control by tension controller to produce a tension error output, and sending this tension error signal to only each of the downstream stands relative to the last stand to change the speed of only each of the downstream stands relative to said last stand at the same rate by using said tension error output as a stand speed reference to vary the interstand tension in the workpiece to effect a gauge correction to obtain said on gauge material in said head end of said workpiece, and at the same time causing said tension controller to send no tension error signal to said last stand.

11. A method of claim 10, the steps further comprising:

for the full run operation of said mill, deactivating said delivery automatic gauge control by tension controller, thereby discontinuing said changing of the speed of each downstream stand by said stand speed reference based on said employment of said delivery automatic gauge control by tension controller and said tension controller between said last two stands, changing said interstand tension regulators from said tension by speed mode to a tension by roll gap mode, activating and operating only said delivery automatic gauge control by speed controller to generate a new stand speed reference for changing the speed of each of said downstream stands relative to said last stand, and supplying said change in speed reference to the speed regulator of each downstream stand relative to said last stand to drive the rolls of each downstream stand at a speed such that the speed of each stand cooperates with the tension by roll gap control for gauge control of said workpiece.

12. A method of claim 11, the steps further comprising:

in the tailing out phase of said mill, deactivating said delivery automatic gauge control by speed controller, employing said tension by speed mode for the interstand tension regulators, and using the tension controller between the last two stands of the mill to measure the actual tension in said workpiece between said two last stands, providing a desired tension input to said tension controller, measuring the delivery gauge thickness of said workpiece at the exit end of said last stand of said mill by said delivery gauge sensor and producing a delivery gauge error signal, energizing and operating only said delivery automatic gauge control by tension controller which is activated by said delivery gauge error signal and generating and sending an output from said automatic gauge controller by tension controller to said tension controller located between said two last stands, in said tension controller between said last two stands comparing said actual tension in said workpiece between said last two stands to said desired tension input and summing the tension difference with said output from said delivery automatic gauge control by tension controller to produce a tension error output, and changing the speed of each of the downstream stands relative to said last stand at the same rate by using said tension error output as a stand speed reference to vary the interstand tension in the workpiece to effect a gauge correction to obtain said on gauge material in said tail end of said workpiece.

13. A method of claim 12, wherein said workpiece being rolled is sheet metal.

14. A method of claim 12, wherein said workpiece being rolled in strip metal.

* * * * *

UNITED STATES PATENT AND TRADEMARK OFFICE

CERTIFICATE OF CORRECTION

PATENT NO. : 4,998,427

DATED : March 12, 1991

INVENTOR(S) : ROBERT S. PETERSON and JOHN A. LARSEN

It is certified that error appears in the above-identified patent and that said Letters Patent is hereby corrected as shown below:

Column 6, line 43, "delayed" should be --decayed--.

Column 6, line 44, "decayed" should be --delivery--.

Column 6, line 53, "deliver" should be --delivery--.

Claim 1, column 9, line 54, "comprising" should be --comparing--.

Signed and Sealed this

Twenty-sixth Day of April, 1994

Bruce Lehman

*Attest:*

BRUCE LEHMAN

*Attesting Officer*

*Commissioner of Patents and Trademarks*